United States Patent [19]

Rushansky

[11] Patent Number: 4,620,071

[45] Date of Patent: Oct. 28, 1986

[54] THREE POSITION ELECTRICAL SWITCH

[75] Inventor: Yuliy Rushansky, Port Washington, N.Y.

[73] Assignee: Slater Electric Inc., Glen Cove, N.Y.

[21] Appl. No.: 679,559

[22] Filed: Dec. 7, 1984

[51] Int. Cl.[4] ..... H01H 21/22

[52] U.S. Cl. ..... 200/6 BA; 200/339; 307/38

[58] Field of Search ..... 307/38, 112, 113; 200/6 R, 6 A, 6 B, 6 BA, 6 BB, 6 C, 339, 153 L, 1 B

[56] References Cited

U.S. PATENT DOCUMENTS 1,422,447 7/1922 Kelsay ..... 200/6 R X 3,031,547 4/1962 Sorenson ..... 200/6 BA

*Primary Examiner*—A. D. Pellinen

*Assistant Examiner*—Morris Ginsburg

*Attorney, Agent, or Firm*—Morgan & Finnegan

[57] ABSTRACT

An electrical switch device which includes a pair of movable contact arms which are operatively associated with a three-position switch mechanism so as to permit, in a unitary structure, passage of current to a partial load or to a full load and also to prevent passage of current to any load.

11 Claims, 6 Drawing Figures

THREE POSITION ELECTRICAL SWITCH

BACKGROUND AND OBJECTS OF THE INVENTION

The present invention relates generally to electrical switch devices, and, more particularly, to an electrical switch device which, in a unitary structure, permits energization of one or two electrical loads (or partial or full loading) by an electrical power source.

Electrical switch devices are commonly used throughout the electrical distribution systems of homes, office buildings and other similar structures for permitting the coupling and decoupling of an electrical power source to a particular load (typically, a lighting arrangement, electrical outlet receptacles, etc.). Relatively recently, changes have been enacted in various electrical codes, with the intention of conserving electricity. For example, the code regulations in many municipalities (especially, in several large cities) now require that in offices which are not being utilized after hours, the lighting must be reduced to no more than half level.

Heretofore, in order to enable one to select between full-load and partial-load energization, the electrical distribution wiring has required pairs of separate switch devices, each separate switch being installed so as to control only a portion (usually half) of the desired loading (typically the lighting fixture) in a particular room. For example, in a bank of fluorescent lamps, half of the lamps would be connected to one switch while the other half would be connected to a second switch. Thus, when full lighting is no longer desired, one switch can be opened to leave only half of the lamps energized.

Although such arrangements have served to satisfy energy conservation regulations, they suffer several drawbacks. For example, multiple separate switch devices must be utilized, thereby doubling the number of devices required and adding to the labor required to install and wire the devices, and, often requiring additional electrical power cable. Moreover, where retro-installation is desired or required, larger outlet boxes would have to be installed in order to accommodate the added switches, thereby increasing the materials and labor costs of such installations.

Accordingly, it is an object of the present invention to provide a new and improved electrical switch device. It is another object of the present invention to provide a new and improved device which enables, in a unitary switch structure, energization of either a partial load or a full load (or one or two separate loads) for conservation of electrical energy.

It is a further object of the present invention to provide such an energy conserving electrical switch device which can be used in new construction or can be retro-installed in existing structures. It is still ahother object of the invention to provide such an energy conserving electrical switch device which can be manufactured in sizes to accommodate different current capacities such as 20 amp or 30 amp current lines.

These and other objects and advantages of the present invention will become readily apparent to those skilled in the art either from a review of the present description or from practice with the invention, the same being realized by the structures and arrangements of parts, herein disclosed.

SUMMARY OF INVENTION

Briefly described, the electrical switch device of the present invention includes a switch housing with at least one source terminal/contact therein for termination to an electrical power cable from an electrical power source, first and second load contact/terminals for termination to separate electrical loads, and a three-position switch member in the housing. A pair of movable electrical contact arms are associated with two of the terminal/contacts in the switch housing, and the switch member is operatively associated with the movable arms so as to close both movable arms for energizing all electrical loads connected to each of the load contact-/terminals when the switch member is in a first, or full load, position; to cause only one of the movable arms to be closed and thereby energize only the electrical load(s) connected to one load contact/terminal when the switch member is in a second, or partial load, position; and, to cause both movable arms to remain open for preventing passage of current to any electrical load connected to either of the load contact/terminals when the switch member is in a third, or fully open, position.

DETAILED DESCRIPTION OF A PREFERRED EMBODIMENT

Figure 1:
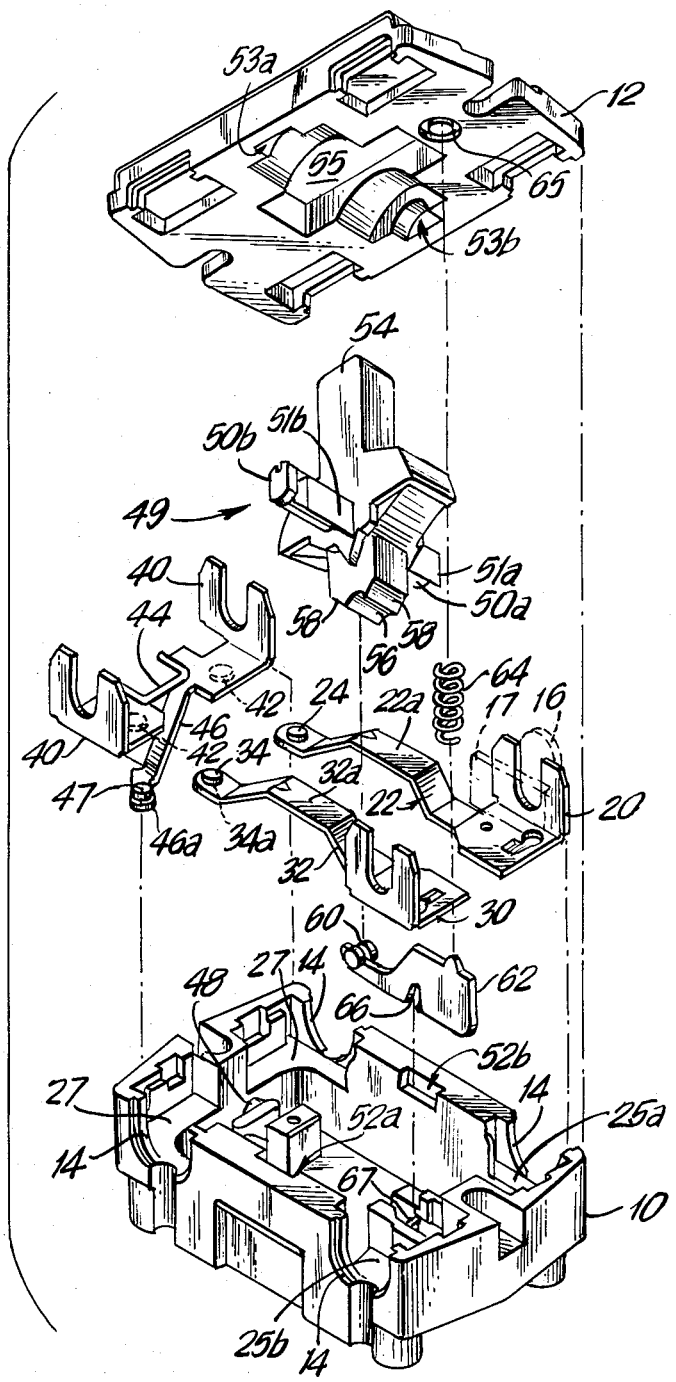
FIG. 1 is an exploded view of a preferred embodiment of electrical switch device according to the present invention.

Referring now to the drawings, there is shown in FIG. 1 an exploded view illustrating various aspects of a preferred embodiment of the electrical switch device according to the present invention. As here embodied, the switch device inlcudes a body portion 10 and cover member 12 which, together, provide a generally closed switch housing. The switch housing 23 is generally similar to that used in other switch devices, such as, for example, heavy duty switches sold under Catalog No. 760 or Catalog No. b 762 by the assignee hereof, Slater Electric Inc. of Glen Cove, N.Y. Thus, the body 10 includes, as here embodied, four slots (each indicated at 14) for exposing the terminals and associated termination screw (one such termination screw is shown in phantom at 16 along with its associated terminal plate 17) for terminating, or connecting, a conductor of an electrical power cable to a desired electrical contact in the switch device.

Two of the terminals in the device are each coupled to (or formed integrally with) a movable arm which carries an electrical contact adapted to electrically mate with a stationary electrical contact in the switch device.

To this end, a first contact/terminal 20 and associated movable arm 22 (with electrical contact 24 mounted at its free end) is mounted adjacent a suitable shoulder (indicated at 25*a*) formed at one side of body 10. Contact/terminal 20 is mounted within the switch housing with arm member 22 free to flex, in cantilever-like manner, such that the free end of arm 22 can swing from mating engagement with a stationary contact to a non-mating configuration, as will be explained in greater detail hereinafter.

A second, similar contact/terminal 30 and associated arm member 32 is likewise mounted at a similar shoulder 25*b* formed at the other side of body 10, with contact 34 mounted to its upper surface. Contact/terminal 30 is also fixedly mounted within the switch housing with its associated arm member 32 free to flex, in cantilever-like manner, such that the free end of arm 32 can swing from mating engagement with a stationary contact through an intermediate non-mating position to a second mating engagement with another stationary contact, as will be explained hereinafter.

As here embodied, a pair of interconnected stationary contact/terminals, each indicated at 40, are fixedly mounted to, or seated adjacent, shoulders 27 which are generally similar to shoulders 25*a* and 25*b*. An electrical contact (each indicated at 42) is mounted to the bottom of each stationary contact/terminal 40. As here embodied, the contact/terminals 40 are interconnected by a generally "U"-shaped "jumper" bar 44 which is welded across them, thereby to energize both stationary contact/terminals 40 simultaneously. In addition, one of the contact/terminals 40 also includes an arm segment 46 depending downwardly therefrom, with an electrical contact 47 mounted thereto so as to be disposed opposite one of the electrical contacts of the interconnected contact/terminals 40.

As here embodied, arm 46 is a cross-over member extending angularly downwardly from one contact/terminal 40, and includes a foot portion 46*a* for supporting contact 47 in spaced relation under the contact 42 on the other contact/terminal 40. Such arrangement enables use of readily available electrical wiring device parts. However, the arm 46 can be formed in any convenient manner so long as the terminal thereon is disposed generally opposite a contact on one of the stationary contact/terminals 40. Advantageously, a slanted wall member, indicated at 48, can be formed in the housing to prevent over-bending of the arm 46, if desired.

It will similarly be understood that by welding "jumper" bar 44 between the two contact/terminals 40, a commonly available L-shaped contact/terminal member can be used, thereby obviating the need for fabricating new parts. However, of course, any integral contact/terminal structure could be specifically fabricated to achieve the desired result.

As here embodied, the switch mechanism is a three-position toggle switch 49 having a shaft made up of portions 50*a* and 50*b* which project from opposite sides of the toggle. The bottom of each shaft portion, 50*a* and 50*b*, includes an axially offset cam member (indicated at 51*a* and 51*b*, respectively) for causing angular displacement of the movable arm members as will be explained hereinafter.

For purposes of clearly illustrating the offset cam members 51*a* and 51*b*, the depiction of toggle switch 49 has been turned around in FIG. 1. This has been done solely for illustration and it will be understood that, when assembling the device, the toggle is actually oriented so that the cam members are offset on the side of shafts 50*a* and 50*b* that face the movable contacts 24 and 34 (i.e., the toggle is rotated 180° relative to the orientation shown in FIG. 1). The shaft portions 50*a*, and 50*b* are thus received in slots 52*a* and 52*b*, respectively, formed in opposite sidewalls of body 10 (and corresponding recesses 53*a* and 53*b* formed in the bottom of cover 12) for pivotal movement when actuated by handle 54 which extends through cover opening 55 of the assembled device.

The bottom of toggle switch 49 is formed with a central camming notch 56 situated between a pair of oppositely inclined bevelled camming surfaces (each indicated at 58) for engaging the bearing member 60 of rocker plate 62 which is spring 64—biased against the bottom of cover 12 via toroidal recess 65. Plate 62 includes a V-shaped notch 66 which receives and bears against an interior shoulder (indicated at 67) for rocking about the shoulder. (It will be understood that the configuration of the toggle switching mechanism is generally known in the art and detailed description of its operation is not necessary.)

Figure 2A:
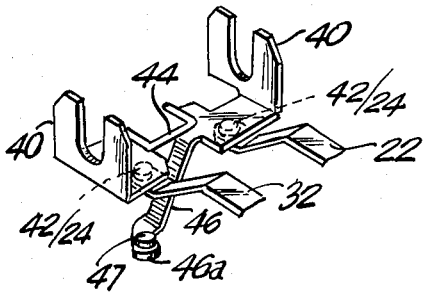
FIG. 2*a* is a partial view, in perspective, of only a portion of the electrical contacts of the device illustrated in FIG. 1, showing full closure of the movable and stationary contacts in accordance with the invention.

In operation (assuming the correct orientation of toggle 49, as explained above), when the toggle handle 54 is thrown fully to the right (as viewed in FIG. 1), the cam members 51*a* and 51*b* do not, by and large, engage the corresponding bearing surface of the arm members 32 and 22, and thereby do not cause any displacement of the arm members. (As here embodied the arm members include raised portions 22*a* and 32*a* which act as the bearing portions.) Thus, the movable contacts 24 and 34 maintain electrical mating contact with the corresponding stationary contacts 42 mounted to the bottom of contact/terminals 40, as shown in FIG. 2*a*. It will be understood that the inherent resilience of the arm members causes them to be biased upwardly against the stationary contacts.

Figure 2B:
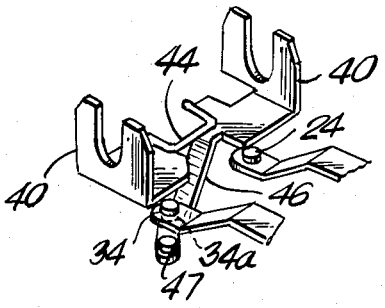
FIG. 2*b* is a view similar to that of FIG. 2*a*, showing the contacts in a completely open configuration.

When toggle handle 54 is moved to the center position, cam members 51*a* and 51*b* partially engage the bearing surfaces of the arm members 32 and 22 to urge them downwardly by a sufficient amount so as to cause disengagement of all electrical mating engagement between the movable contacts 24 and 34 and their corresponding stationary contacts 42, as illustrated in FIG. 2*b*. Thus, the switch is fully open and no current flows between the stationary contact/terminals 40 and the movable arm members 22 and 32.

Figure 2C:
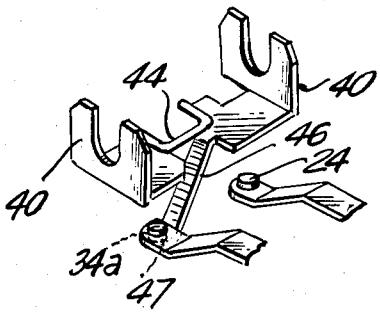
FIG. 2*c* is a view similar to that of FIGS. 2*a* and 2*b*, showing partial closure or energization of the contacts in accordance with the invention.

Finally, when toggle handle 54 is thrown fully to the left, the peak of camming members 51*a* and 51*b* engage the bearing portions of arm members 32 and 22, thereby causing the arm members to be fully depressed. As a result, the movable contact 34*a* on the bottom arm member 32 makes electrical mating engagement with the stationary contact 47 on foot portion 46*a* of arm segment 46, as illustrated in FIG. 2*c*. However, the other movable arm member 22 remains de-energized as it still does not make electrical mating contact with any portion of the stationary contacts.

Figure 3:
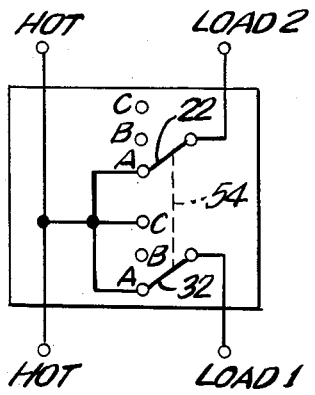
FIG. 3 is a schematic wiring diagram for an exemplary installation of the device illustrated in FIG. 1.

Referring then to FIG. 3, there is shown a schematic wiring diagram illustrating a wiring configuration for an exemplary installation of the embodiment of the switch device illustrated in FIG. 1. As here shown, a conductor (the "hot" line) of an electrical power cable segment leading from an electrical power source is terminated to one of the stationary contact/terminals 40. The corresponding "hot wire" conductors of two other power cable segments are similarly terminated, one each, to terminals 20 and 30. These other power cable segments may, for example, be connected to alternating sets of lights or alternating ballasts of one or more sets of fluorescent lighting fixtures. (The remaining stationary contact/terminal 40 can be used, for example, for other downstream connections, if desired.) It will be understood that the neutral conductors of the cables need not be connected to the switch mechanism, and are simply wired together to complete the actual circuit wiring.

When toggle 54 is thrown fully to the right (or downwardly if the switch housing is mounted vertically with the "common" contact/terminals 40 oriented upwardly), both loads 1 and 2 will be energized since both movable arms 22 and 32 are in electrically mating association with the stationary contacts 42, as indicated schematically at A—A of FIG. 3. When toggle 54 is moved to the center position, as indicated schematically at position B—B, neither load will be energized because both switching movable arms will be open. When toggle 54 is moved fully to the left (or upwardly), as indicated schematically at C—C, only load 1 will be energized because movable arm 32 is in electrically mating association with arm 46 while movable arm 22 remains deactivated.

Thus, when the switch device of FIG. 1 is wired to a bank of lighting fixtures in office buildings, a person can select either full-intensity lighting or partial-intensity lighting by moving toggle 54 to either of the two extreme positions. Full-intensity would be used, for example, during regular working hours or at night when office work or maintenance efforts are under way in a particular area. Partial-intensity lighting could be used during off-hours when only partial lighting is desired, for example, for security purposes, or when ambient lighting is bright enough to obviate the need for full intensity lighting during normal work hours.

Figure 4:
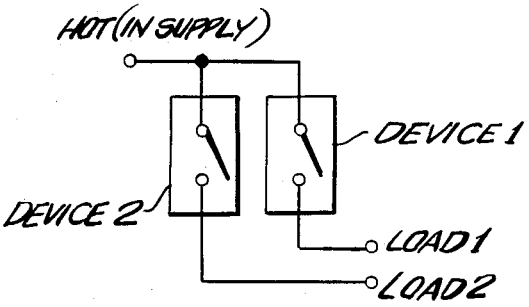
(PRIOR ART) FIG. 4
FIG. 4 is a schematic wiring diagram of a typical two-switch arrangement heretofore commonly used in prior art installations.

In order to accomplish the foregoing result by prior art devices, two switch devices will be required, as shown in FIG. 4. Each separate device—i.e., Device 1 and Device 2—would control one of the two loads, Load 1 and Load 2, respectively. A user would have to select the correct combination of switch positions on the two separate devices to achieve the desired load energization.

It will be understood by those skilled in the art that the foregoing description is illustrative and exemplary of the present invention, and is not intended to be limiting of the invention. Thus, variations and modifications may be made without departing from the broad principles, features and aspects of the invention.

What is claimed is:

1. An improved electrical switch device, for use with electrical loads, having a switch housing with at least two source terminal/contacts therein for termination to an electrical power cable from an electrical power source and first and second load contact/terminals for termination to separate electrical loads, and a generally three-position switch member in the housing, wherein the imporvement comprises a pair of shafts for actuative a pair of movable electrical contact arms, said shafts being unitary with and extending from said switch member, said arms assoicated with two of the terminal/-contacts in said housing, said switch member being actuated so as to close both said movable contact arms for energizing all electrcial loads connected to each of the load contact/terminals when said seitch member is in a first, full load, position, and to cause only one of said movable contact arms to be closed for energizing any electrical load connected to only one of said first and second load contact/terminals when said switch member is in a second, partial load, position, and to cause both movable contact arms to be open for de-energizing each eletrcial load connected to either load contact/terminals when said switch member is in a third, fully open, position.

2. A switch device according to claim 1, wherein each of said movable contact arms is connected to one of said first and second load contact/terminals and adapted to open and close relative to a generally stationary electrical contact on said source terminal/contacts.

3. A switch device according to claim 2, wherein each of said source terminal/contacts includes a stationary pair of contacts and a third electrical contact coupled thereto but spaced from one of the stationary pair of contacts to provide an oppositely disposed, spaced, pair of dual stationary contacts, and wherein a movable electrical contact is mounted to each movable contact arm, generally at the free end of each contact arm, for making electrical mating engagement with the stationary pair of contacts, the free end of one of said movable contact arms being disposed between the contacts comprising said dual stationary contacts and including a second electrical contact for permitting electrical mating with the third electrical contact, and wherein said switch member provides electrical mating between the movable electrical contacts and the pair of stationary electrical contacts when in said first position, provides electrical mating only between said second and third contacts when in said second position, and provides no electrical mating when in said third position.

4. A switch device according to claim 2 which includes a pair of said source terminal/contacts which are electrically coupled together, said source terminal/contacts adapted to remain relatively stationary in said housing and supporting a pair of electrical contacts located so as to mate, in one-to-one correspondence, with an electrical contact mounted to each of said movable contact arms when said switch member is in the first position, one of said source terminal/contacts further including a third electrical contact adapted to electrically mate with only one of said movable contact arms when said switch member is in said second position.

5. A switch device according to claim 4, wherein said third contact is supported on an arm segment extending from one of said source terminal/contacts so as to be spaced from but disposed generally opposite one of said contacts on said source terminal/contacts, with one of said movable contact arms being free to electrically mate with either of said third contact and one of said contacts on said source terminal/contacts disposed opposite thereto.

6. A switch device according to claim 2, which includes two said source terminal/contacts with a stationary electrical contact on each, said source terminal/-contacts being electrically coupled to each other, such that both said source terminal/contacts are simultaneously electrically communicated with an electrical power source terminated to either one of the source terminal/contacts.

7. A switch device according to claim 6, wherein said source terminal/contacts are electrically coupled by a jumper member.

8. A switch device according to claim 7, wherein one of said source terminal/contacts includes an arm segment which supports a third stationary electrical contact in spaced relation from one of said stationary contacts, and wherein one of said movable contact arms supports a pair of electrical contacts such that said one of said movable arms can be in electrically mating engagement with either of said one stationary contact and said third stationary contact.

9. A switch device according to claim 8, wherein said arm segment is a cross-over member extending angularly from said one source terminal/contact to the other of said source terminal/contacts.

10. A switch device according to claim 7, wherein said jumper member is a generally U-shaped electrically conductive member welded to said source terminal/-contacts.

11. An improved electrical switch device, for use with electrical loads, having a switch housing with at least two source terminal/contacts therein for termination to an electrical power cable from an electrical power source and first and second load contact/terminals for termination to separate electrical loads, and a generally three-position switch member in the housing, wherein the improvement comprises a pair of movable electrical contact arms associated with two of the terminal/contacts in said housing, said switch member being actuated so as to close both said movable contact arms for energizing all electrical loads connected to each of the load contact/terminals when said switch member is in a first, full load, position, and to cause only one of said movable contact arms to be closed for energizing any electrical load connected to only one of said first and second load contact/terminals when said switch member is in a second, partial load, position, and to cause both movable arms to be open for de-energizing each electrical load connected to either load contact/terminals when said switch member is in a third, fully open, position, wherein each of said movable contact arms is connected to one of said first and second load contact/terminals and adapted to open and close relative to a generally stationary electrical contact on said source terminal/contacts, said source terminal/-contacts including a pair thereof which are electrically coupled together, said pair of source terminal/contacts adapted to remain relatively stationary in said housing and supporting a pair of electrical contacts located so as to mate, in one-to-one correspondence, with an electrical contact mounted to each of said movable contact arms when said switch member is in the first position, one of said source terminal/contacts further including a third electrical contact adapted to electrically mate with only one of said movable contact arms when said switch member is in said second position, said third contact being supported in a crossover member extending angularly from one of said source terminal/contacts towards the other so as to be spaced from but disposed generally opposite one of said contacts on said source terminal/contacts, with one of said movable contact arms being free to electrically mate with either of said third contact and one of said contacts on said source terminal/contacts disposed opposite thereto.

* * * * *